US005377978A

United States Patent [19]

Lee

[11] Patent Number: 5,377,978

[45] Date of Patent: Jan. 3, 1995

[54] GOLF CLUB HOSEL SHIFT

[76] Inventor: Michael C. W. Lee, No. 82-12 San Lung Road, Ta-Liao Hsiang, Kaohsiung, Taiwan, Prov. of China

[21] Appl. No.: 266,886

[22] Filed: Jul. 5, 1994

[51] Int. Cl.[6] ..... A63B 53/00

[52] U.S. Cl. ..... 273/77 A; 273/80 C; 273/167 G

[58] Field of Search ..... 273/77 R, 77 A, 167 G, 273/80 C, 79, 168, 169

[56] References Cited

U.S. PATENT DOCUMENTS

| | | | |
|---|---|---|---|
| D. 322,651 | 12/1991 | Parente et al. . | |
| 2,784,969 | 3/1957 | Brandon . | |
| 3,655,188 | 4/1972 | Solheim | 273/77 A |
| 3,703,824 | 11/1972 | Osborne | 273/77 A |
| 3,966,210 | 6/1976 | Rozmus . | |
| 4,280,700 | 7/1981 | Plagenhoef | 273/77 A |
| 4,854,581 | 8/1989 | Long . | |
| 4,895,367 | 1/1990 | Kajita et al. . | |
| 4,986,541 | 1/1991 | Teramoto et al. . | |

FOREIGN PATENT DOCUMENTS 2194737 3/1988 United Kingdom .

*Primary Examiner*—Sebastiano Passaniti
*Attorney, Agent, or Firm*—Richard C. Litman

[57] ABSTRACT

A set of golf club irons includes variably spaced hosel offsets for each club, with the hosel offset increasing from the higher numbered clubs to the lower numbered clubs. Each of the club heads is provided with a matching center of gravity, and the hosel is shifted toward the center of gravity for the higher numbered clubs and outwardly away from the center of gravity for the lower numbered clubs. This has the effect of reducing the moments of inertia for the higher numbered clubs, thereby providing less stability and greater control for those clubs, and increasing the moments of inertia for the lower numbered clubs, thereby providing greater stability while sacrificing some control. The effect is to provide greater consistency for the lower numbered clubs used for longer distance drives, while providing greater control for higher numbered clubs generally used for shorter shots approaching the green, where accuracy is more important. Optionally, a medial club (e.g., the six iron) may be selected as an intermediate datum for the hosel offset, with the offset decreasing toward the higher numbered clubs and increasing toward the lower numbered clubs.

6 Claims, 2 Drawing Sheets

GOLF CLUB HOSEL SHIFT

FIELD OF THE INVENTION

The present invention relates generally to golf equipment, and more specifically to an improvement in a set of golf club irons in which the club hosel is shifted toward or away from the center of gravity of the club head according to the club number and loft. Such shifting results in changing the length of the arm between the centerline of the hosel and the center of gravity of the club head, thereby altering the moment of inertia of the club head relative to the hosel and shaft to provide greater stability or control of the club head, depending upon the amount and direction of the shift.

BACKGROUND OF THE INVENTION

The game of golf has evolved over the years into a highly complex sport, with many technical innovations for the equipment involved. As played by the professional, any advantage is highly sought after, as any such advantage, even if providing perhaps only an average of a fraction of a stroke advantage over several games, can result in a one or two stroke advantage over a 72 hole match. Amateurs and weekend golfers have the same interest in improving their games, and also seek the most technologically advanced equipment which still falls within the rules, in order to gain the maximum possible advantage.

Accordingly, many technical improvements have been developed for the "irons" or metal headed clubs with which most play accomplished. These irons have evolved into a series of clubs, numbered from one to nine with a "pitching wedge" and/or "sand wedge" beyond the nine iron. These clubs each have a differently angled club head face, with the one iron being closest to the vertical (i. e., the club face being most nearly parallel to the club shaft), and the sand wedge having a club head face angled considerably away from the vertical. The remaining clubs fall into a range between the one iron and the sand wedge. The differently angled club faces will impart a different trajectory and spin to the ball when struck, with the one iron providing the lowest trajectory (least arc) and the least backspin, thus generally causing the ball to travel farther than the other clubs. A sand wedge will send the ball on a relatively short flight, with a highly arched trajectory, and will also impart considerable backspin on the ball, thus shortening its rollout or even causing the ball to back up after striking the ground.

As can be seen, generally the lower numbered irons are used for relatively long shots, while the higher numbered irons and sand wedge are used for shorter shots, where greater accuracy is required. Accordingly, the lengths of the club shafts are also varied, with the lower numbered irons having longer shafts, thus allowing greater speed for the club head during the swing to impart greater force to the ball, and the higher numbered irons and sand wedge having shorter shafts to provide a golfer with better control. Other variations (club head weights and the location thereof in the heads, external shaping and pattern of the club head face, etc.) have also been developed for the different clubs.

From the foregoing, it will be noted that the angle of the attachment of the club shaft to the club head at the hosel or shank of the club head (known as the "lie angle"), must vary according to the length of the club shaft in order to align the major axis of the club head parallel with the playing surface. Accordingly, the hosels and shafts of the lower numbered irons (with longer shafts) are generally angled further away from the perpendicular, and the higher numbered irons and the wedges are generally angled more closely toward the perpendicular due to the shorter shafts of such clubs.

At this point, it should be pointed out that in any dynamic situation (including swinging a golf club), there are two mutually exclusive concerns: Stability and control The more stable a dynamic device, the more difficult it will be to alter that stability to control the device. On the other hand, the less stable, the easier to control and cause the device to deviate from its stable mode. This is of interest relative to the set of iron golf clubs discussed herein, as it is particularly important to provide for ease of control with the higher numbered clubs, in order to provide for more accurate placement of the relatively shorter shots made with such clubs, generally closely approaching the green and the hole. Conversely, control is not so important with the lower numbered clubs, where stability is of paramount concern for greater consistency on each shot.

These tradeoffs between stability and control of the various iron clubs in a set have heretofore generally been made by shifting the center of gravity of each of the club heads, which affects the moment of inertia of the club. However, another means of altering the moment of inertia is by shifting the distance of the hoseI from the center of gravity of the club head, and this method may have definite advantages over shifting the centers of gravity of each of the club heads. While such hosel shifting has been accomplished before, it has heretofore always included a shift of the centers of gravity of the club heads in combination with the hosel shift.

Accordingly, the need arises for a means of providing greater stability for lower numbered irons of a golf club set, and greater control for higher numbered irons, by respectively shifting the hosel of the club away from the center of gravity of the club head for the lower numbered irons, and toward the center of gravity for the higher numbered irons. The club heads may retain a common center of gravity, if desired, with the hosel shift accomplishing all of the moment of inertia change required for the desired stability and control.

DESCRIPTION OF THE PRIOR ART

U.S. Pat. No. 2,784,969 issued to Thomas 0. Brandon on Mar. 12, 1957 discloses Golf Clubs having a fore and aft hosel offset relative to the arcuate path of the club head during a golf swing. The effect is to align the hosel, and thus the club shaft, with the impact point on the club face for all clubs, no matter what the angle of the club face. No effort is made to provide clubs having variable degrees of stability and control depending upon the club number, as in the present invention, but rather to provide all of the clubs with a balance of stability and control (col. 2, lines 12–16).

U.S. Pat. No. 3,966,210 issued to John J. Rozmus on Jun. 29, 1966 discloses a Golf Club in which the club shaft is aligned with the center of the club face, in order to preclude twisting of an offset club face at the moment such a club face contacts the ball on a golf swing. The club includes weights at opposite ends thereof, to provide a Greater moment of inertia for the club head to preclude twisting at impact with the ball. No attempt is made to lower the moment of inertia of the club head, to provide greater control for relatively shorter shots made with the higher numbered clubs.

U.S. Pat. No. 4,854,581 issued to D. Clayton Long on Aug. 8, 1989 discloses Golf Irons having progressively displaced distances between the centers of gravity of the club heads and the shaft axes, with the displacement being perpendicular to the path of the ball and increasing from the lower numbered irons to the higher numbered irons. However, although the centers of gravity of the club heads are not shown to be displaced laterally within the differently numbered heads, they are displaced vertically and also horizontally along the fore and aft axis of the club head. As the displacement distance is measured perpendicularly to the shaft centerline, this vertical displacement of the centers of gravity of the club heads will also effect the shaft displacement distance, even if the shaft is otherwise identically displaced on a differently numbered club. Thus, the moments of inertia of the various club heads will vary, even without different displacements, unlike the present invention. Moreover, Long requires the shaft axis and vertical line through the center of gravity of the club head to intersect at a fixed distance below the club head, for all club heads (FIG. 5 and column 7, lines 13–25 of the Long disclosure). As the lie angle of the club shaft relative to the horizontal tangent to the club head changes, so does the distance between the shaft centerline and the center of gravity of the club head, when the intersection point is at a fixed distance from the center of gravity. Thus, the Long displacement is dependent upon an angular displacement (the lie angle), unlike the present hosel shift based upon absolute distance. With the present invention's identical center of gravity height and lateral placement in each of the different club heads, the hosel shift and different club head weights are the only variables affecting the moment of inertia, unlike the Long patent with its shifting centers of gravity and angular displacement of the club shafts. Long also attempts to equalize (or nearly so) the moment of inertia of all of the club heads, as disclosed in Table 5 of the Long disclosure. The present hosel shift provides a higher moment of inertia for the lower numbered clubs (the "longer" irons, even though their club head weights may be lower) than for the higher numbered clubs, in order to increase the stability of the longer irons and correspondingly increase the controllability of the shorter irons.

U.S. Pat. No. 4,895,367 issued to Ryota Kajita et al. on Jan. 23, 1990 discloses a Golf Club Set having fore and aft hosel or shank offset for a complete set of clubs including irons and woods. No offset outside of the plane of the club swing is disclosed; the Kajita et al. offset is more akin to the patent to Brandon discussed above.

U.S. Pat. No. 4,986,541 to Mitsutake Teramoto et al. on Jan. 22, 1991 discloses an Iron Golf Club Set having "face progression values," i. e. , the distance between the lower or leading edge of each club face and the centerline of the hosel is varied progressively over the range of clubs. The offset is in the fore and aft direction, as in the Kajita and Brandon patents discussed above.

U.S. Design Pat. No. D-322,651 issued to Richard E. Parante et al. on Dec. 24, 1991 discloses a design for the heads of a golf club iron set. It appears that the hosel is variably offset in the fore/aft direction; in each case, the hosel is at least slightly forwardly offset. The design is more closely related to the articles disclosed in the patents to Brandon, Kajita, and Teramoto discussed above.

Finally, British Patent No. 2,194,737 to Maruman Golf Co., Ltd. and published on Mar. 16, 1988 discloses a Golf Club And A Set Of Golf Clubs including fore and aft offset of the leading edge of the hosel relative to the leading edge of the club face. The offset, however, is precisely opposite that of the Brandon, Kajita, and Teramoto patents discussed above, in that it decreases with increasing club number and loft of the club head.

None of the above noted patents, taken either singly or in combination, are seen to disclose the specific arrangement of concepts disclosed by the present invention.

SUMMARY OF THE INVENTION

By the present invention, an improved golf club iron set is disclosed.

Accordingly, one of the objects of the present invention is to provide an improved golf club iron set which provides for increased stability for the lower numbered (longer driving distance, less loft) clubs and increased control of the higher numbered (shorter driving distance, greater loft) clubs.

Another of the objects of the present invention is to provide an improved golf club iron set which provides for increased stability of the lower numbered clubs and increased control of the higher numbered clubs by means of varying the moment of inertia of the club head with respect to the major axis of the club head, i.e., perpendicular to the plane of the club swing arc.

Yet another of the objects of the present invention is to provide an improved golf club iron set which provides matched centers of gravity for each of the club heads, and provides for variation in the moments of inertia of the club heads solely by means of varying the hosel distances from the centers of gravity of the club heads with respect to the major axes of the club heads.

Still another of the objects of the present invention is to provide an improved golf club iron set which uses the hosel position of the six iron as a datum, and shifts the hosel inwardly toward the center of gravity of the club head to reduce the moment of inertia for higher numbered clubs for greater control thereof, and shifts the hosel outwardly away from the center of gravity of the club head to increase the moment of inertia for lower numbered clubs for greater stability thereof.

A final object of the present invention is to provide an improved golf club iron set for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENT

Figure 3:
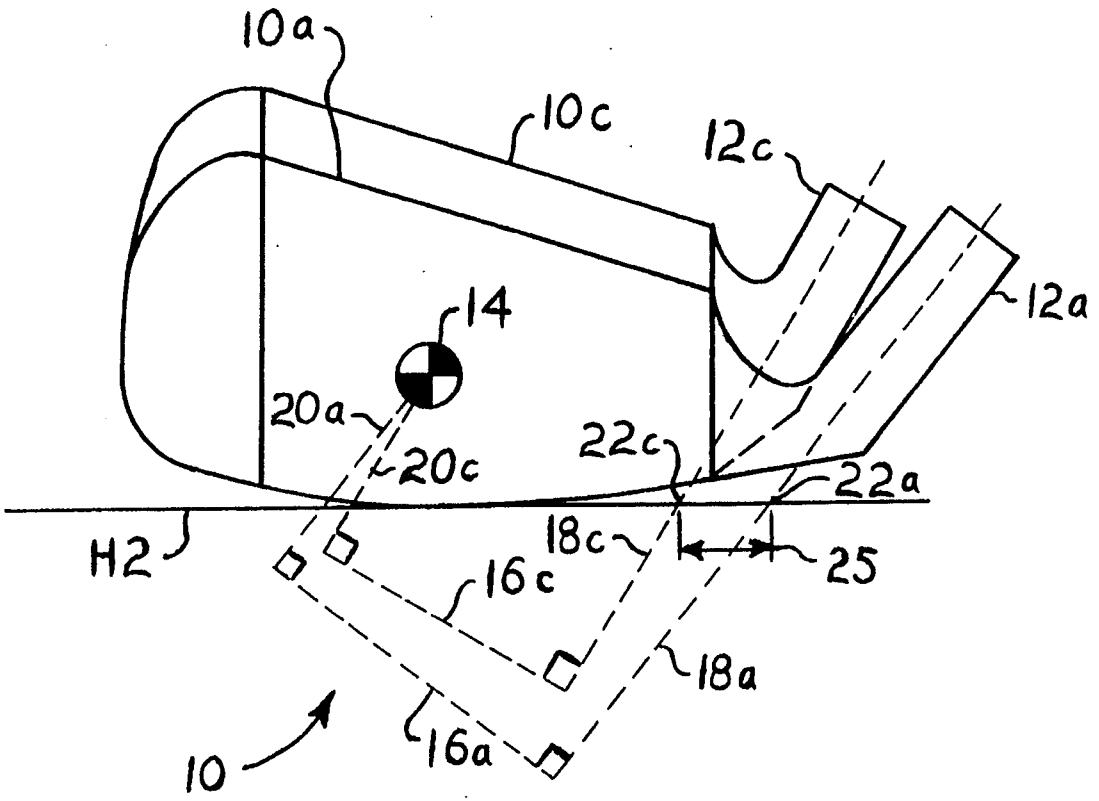
FIG. 3 is a simplified schematic front elevation view similar to the view of FIG. 2, but deleting the median club head for clarity.

Referring now particularly to FIG. 3 of the drawings, the present invention will be seen to relate to a set of golf club irons 10, comprising at least a one iron 10*a* and a sand wedge 10*c*. (Throughout the present specification, like letters of each of the drawing numbers will refer to like clubs.) It will be noted that a full set of irons will include clubs numbered from one through nine inclusive, with a pitching wedge and a sand wedge following the nine iron in the order of their decreasing face angles from the vertical, as is well known in the art. However, in order to simplify the drawings and following discussion, only a club representing each end of the range is shown. It will be understood that the present invention is incrementally applicable to all of the irons in a set of clubs.

Each iron 10*a* through 10*c* in the set 10 has a differently angled club face relative to the vertical, with the one iron 10*a* having the steepest face (i.e., closest to vertical) and the sand wedge 10*c* having the shallowest face (i. e., closest to horizontal), with other clubs falling between, as is well known in the art. Also, each club 10*a* through 10*c* includes a hosel, respectively 12*a* through 12*c*, providing connection means between the club heads 10*a* through 10*c* and their respective club shafts (not shown). Each hosel 12*a* through 12*c* will be seen to be at a different lie angle to the horizontal or ground plane H2 due to the relatively longer shafts generally provided for the lower numbered irons. Hence, the hosel 12*a* for the one iron 10*a* will be seen to have a shallower lie angle relative to the horizontal H2 than the hosel 12*c* for the sand wedge 10*c*, with hosels for other clubs having intermediate lie angles. This variation in hosel lie angle relative to the horizontal allows the major axis of each club head to lie substantially horizontal and parallel to the ground plane H2 regardless of the length of the club shaft. Again, this technology of varying the hosel lie angle to allow for different shaft lengths is known in the art, as indicated in the prior art FIG. 1.

Figure 1:
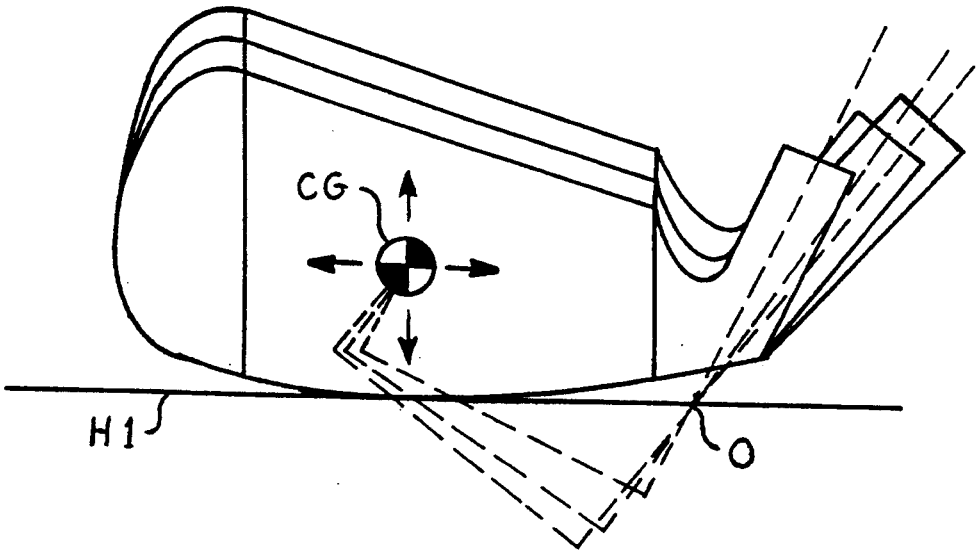
FIG. 1 PRIOR ART
FIG. 1 is a schematic front elevation view of the overlying faces of three different golf club irons, showing the prior art means of adjusting the center of gravity of the club heads in order to attempt to achieve better control and to reposition the moments of inertia.

In the prior art, standard procedure is to have the centerline of each of the hosels pass through the ground plane H1 at a common point O, as shown in FIG. 1. As the moment of inertia of a given golf club head relative to the shaft is dependent upon the distance between hosel centerline and center of gravity of the club head, as well as the weight of the club head, any change in the moment of inertia of a club head requires that either the weight or the location of the center of gravity of the club head (or both) be changed. For example, increasing the weight by an amount sufficient to significantly increase the moment of inertia of the longer (lower numbered) irons has undesirable effects, as it changes the "feel" of each of the clubs due to their different weights; normally, the shorter, higher numbered irons have heavier club head weights, to compensate for their shorter and lighter shafts. A golfer would then have to become acclimated to the shorter or higher numbered irons having both lighter club head weights as well as the traditionally lighter and shorter shafts, in addition to their other characteristics. Thus, the common practice has been to vary the relative locations of the centers of gravity of the club heads, in order to adjust the length of the arm between the hosel and the center of gravity, and to increase the club head weights of the shorter irons.

However, this means of adjustment also has negative effects, as there is only one optimum location for the center of gravity in a golf club head, and that is concentric with the geometric center of the club head, in order that a ball struck at the geometric center will have the center of gravity of the club aligned with it at impact in order to eliminate any undesirable moments about the geometric center which might cause the club head to be deflected angularly and therefore cause the ball to hook, slice, or travel a different path than that intended. Thus, it is important that the center of gravity of a set of iron golf club heads be consistent between each of the clubs, preferably located at the same relative point in each club head.

Each club head 10*a* through 10*c* will be seen to have a center of gravity 14, where the weight of each of the club heads 10*a* through 10*c* is effectively concentrated. In the golf irons of the present invention, this center of gravity 14 has the same relative location for all club heads 10*a* through 10*c*, and thus only a single figure number is needed. However, a review of the prior art FIG. 1 shows that standard practice heretofore has been to vary the location of the center of gravity CG either toward or away from the hosel, and/or up or down relative to the bottom edge of the club head (shown tangent to the horizontal ground plane HI), as shown by the arrows radiating from the center of gravity CG in prior art FIG. 1. While such shifting of the center of gravity CG effects the moments of inertia of a set of golf clubs, it has other deleterious effects, as discussed above.

In the present invention, the center of gravity 14 is fixed, preferably in horizontal alignment with the geometric center of each of the club heads 10*a* through 10*c*. Rather than shifting the center of gravity 14, the locations of the hosels 12*a* through 12*c* are shifted toward or away from the center of gravity 14, in order to vary the length of the arms (respectively 16*a* through 16*c*) between the hosel centerlines 18*a*–18*c* and the center of gravity 14. (It will be noted that the arms 16*a*–16*c* must be perpendicular to their respective hosel centerlines 18*a*–18*b*, as shown by the conventional symbols at the intersections of the arms 16*a*–16*c* and their respective hosel centerlines 18*a*–18*c*, in order to provide an accurate measurement of the length of the arms 16*a*–16*c*. The lengths of the arms 16*a*–16*c* may be measured at any point along the hosel centerlines 18*a*–18*c*, by providing extensions 20*a*–20*c* from the center of gravity 14 and parallel to their respective hosel centerlines 18*a*–18*c*.)

The results of the variation in the lengths of the arms 16*a*–16*c* may be measured along the ground plane H2, where the hosel centerlines 18*a*–18*c* intersect the ground plane H2. In FIG. 1, this is shown as a hosel shift distance 25 measured between the intersections 22*a* and 22*c* of the hosel centerlines 12*a* and 12*c* with the ground plane H2. It will be noted that this distance 25 has no particular vector or direction, and thus no relative positive or negative value, in FIG. 1; it may be measured in either direction, and/or from any arbitrary reference point as desired. For example, the one iron 10*a* could be used as an absolute reference, with each of the arms for each of the other clubs being reduced in length to provide negative hosel shifts relative to the one iron 10*a* and consequent reductions in moments of inertia relative to the one iron. Alternatively, the sand wedge 10*c* could be used as a reference, with all arms or distances between the center of gravity 14 and hosel centerlines being positive or longer in order to provide positive hosel shifts. In any case, providing a longer arm (and thus a relatively larger hosel shift) provides a larger moment arm, and thus increases the stability and reduces the maneuverability or controllability of the club, while providing a shorter arm (and thus a relatively smaller hosel shift) provides a smaller moment arm, and thus decreases the stability of the club while increasing its controllability or maneuverability.

Preferably, the amount of hosel shift between each club is progressive and incremental, with the difference between each club being substantially constant in order to avoid substantial differences from one club to the next. While no specific amount of incremental or total hosel shift is required herein, as an example a hosel shift distance 25 of some 12 millimeters may be used in the present hosel shift invention, measured from either the one iron 10*a*, the sand wedge 10*c*, or other club or reference point as desired. Other shift distance quantities may be applied to the present invention as required or desired.

Having selected the one iron 10*a* as an arbitrary reference point, it will be seen that reducing the arm 16*a* between the center of gravity 14 and the hosel centerline 18*a* from the one iron 10*a* reference will result in a lower moment of inertia for the club head 10*c* (assuming other factors to be equal), thus decreasing the stability of the club to provide greater control for each golf shot made with such a club 10*c*. As the moment of inertia is directly dependent upon the weight but dependent upon the square of the arm, it will be seen that changing the arm or hosel shift will result in a greater change to the moment of inertia than merely changing the weight. This is especially important in terms of the present invention, as the standard increase in weight of the shorter (higher numbered) irons, provided to offset their shorter shafts, will be seen to work against a decrease in the moment of inertia of those clubs for ease of control, as taught by the present disclosure. The relative decrease in the moment of inertia for the shorter (higher numbered) clubs, e.g., sand wedge 10*c*, makes it easier for the golfer to place shots precisely when using such a club 10*c*. This is important for the higher numbered irons, as such irons are commonly used for relatively short shots approaching the green, where great precision and accuracy is required in an attempt to place the ball as close as possible to the hole.

On the other hand, one of the higher numbered irons, e. g., the sand wedge 10*c* having the shortest club shaft length and club head face with the shallowest angle, may be used as a reference point for measuring the hosel shift distance 25 of the present invention, if desired. The increase in the length of the arm 16*c* between the center of gravity 14 and the hosel centerline 18*c* will result in a relatively higher moment of inertia for a club head 10*a* (assuming other factors to be constant). The stability of such a club head 10*a* is increased accordingly; however, maneuverability or controllability of the club head 10*c* will be decreased. While maneuverability or controllability of the long iron 10*a* is decreased by the relatively larger moment of inertia for such a club, this is of relatively minor concern, as it is far more important to provide consistency for each shot made with the low numbered irons, such as iron 10*a*, as they are used primarily for distance.

Figure 2:
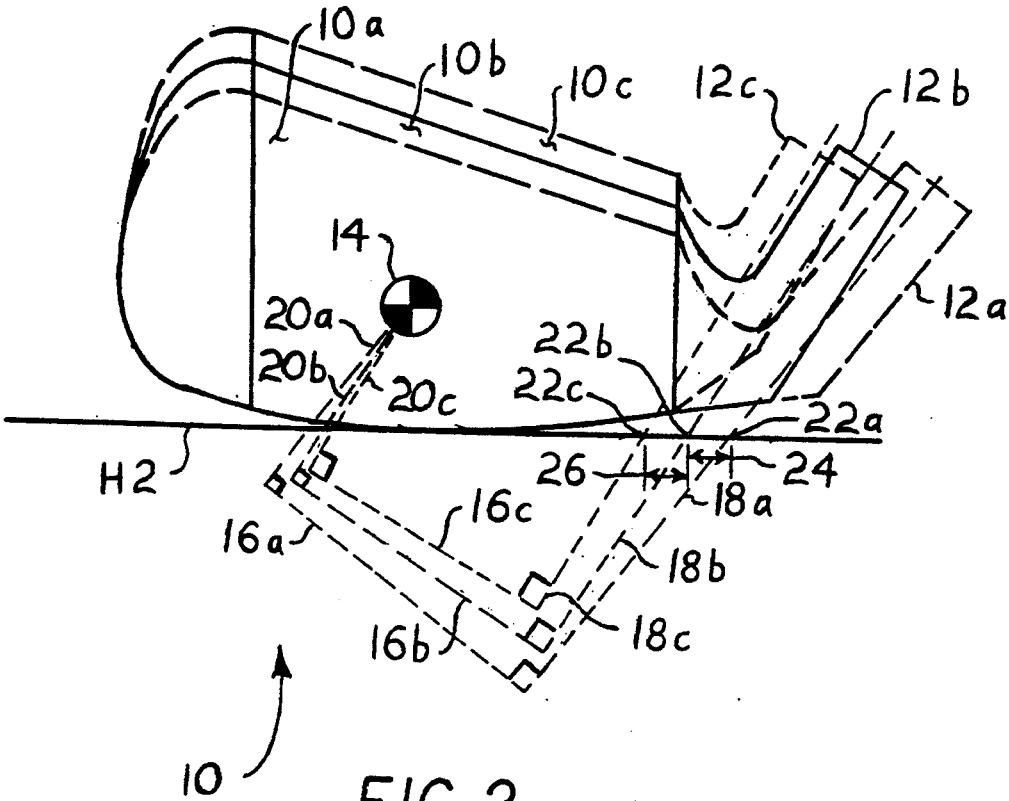
FIG. 2 is a schematic front elevation view of the overlying faces of three golf club irons of the present invention, showing the offsets of their hosels relative to the fixed center of gravity used for each of the club heads.

As noted above, any datum point may arbitrarily be chosen from which to measure the above discussed hosel shift. An example is shown in FIG. 2, where the six iron 10*b* is used. In FIG. 2 the hosel centerline 18*b* of the six iron 10*b* intersects the ground plane H2 at a point 22*b* between the intersection points 22*a* and 22*c* respectively of the hosel centerlines 12*a* and 12*c* of the one iron 10*a* and sand wedge 10*c*, as the six iron is essentially a median club between the one iron and sand wedge insofar as golf club iron characteristics are concerned. Consequently, the hosel centerline 18*a* will be seen to intersect the ground plane H2 at point 22*a*, while the hosel centerline 18*c* intersects the ground plane H2 at point 22*c*. The hosel shift distance 24 between points 22*b* and 22*c* will be seen to be outward, or positive, thus increasing the moment of inertia of a club 10*a* having a longer arm 16*a*, while the hosel shift distance 26 between points 22*b* and 22*a* will be seen to be inward, or negative, thus decreasing the moment of inertia of a club 10*c* having a shorter arm 16*c*. The effects of these relative increases and decreases in moment of inertia have been discussed above; it will be seen that only the reference or datum point for measuring the shift distance has changed between the examples of FIG. 2 and FIG. 3, and that the underlying principle is the same between the two examples and figures.

As in the examples described above, preferably the amount of hosel shift between each club is progressive and incremental, with the difference between each club being substantially constant in order to avoid substantial differences from one club to the next. While no specific amount of incremental or total hosel shift is required herein, as an example a hosel shift distance 24 or 26 on the order of six millimeters respectively between the reference six icon 10*b* and the one iron 10*a*, or between the six iron 10*b* and the sand wedge 10*c*, may be used. Other shift distances 24 or 26 may be used as desired, e. g., a one millimeter negative shift between each of the clubs from the one iron 10*a* to the sand wedge 10*c*, referenced from the one iron 10*a*, or the equivalent one millimeter positive shift from sand wedge 10*c* to one iron 10*a*, referenced from the sand wedge 10*c*, as described further above. Other shift distance reference points and quantities may be applied to the present invention as required or desired.

Accordingly, the present invention will be seen to provide for the variation of the stability, and thus the controllability or maneuverability, of a golf club iron, by shifting the hosel toward or away from the relatively fixed center of gravity location of each of the club heads. By maintaining a relatively fixed center of gravity substantially coincident with the geometric centers of each of the club heads, a ball struck at the geometric center will in effect have the entire mass of the given club head acting directly through the center of the ball, thus eliminating any asymmetric forces which would otherwise tend to twist the club head and deflect the ball or otherwise alter its path (i. e., hook or slice). The increase in hosel shift distance for the lower numbered clubs provides a significant increase in stability, thus providing greater consistency for long iron shots for the golfer, while a decrease in hosel shift distance for the higher numbered clubs sacrifices some stability for an increase in controllability or maneuverability of the club and head for shots of shorter distance when approaching the green or hole. Accordingly, the present invention provides significant advantages for the golfer, providing stability and controllability in the different irons of a golf club iron set as required of the different clubs, while maintaining a constant center of gravity position for consistency between the different clubs to further aid the golfer.

It is to be understood that the present invention is not limited to the sole embodiment described above, but encompasses any and all embodiments within the scope of the following claims.

I claim:

1. A set of golf club irons comprising one through nine irons, a pitching wedge, and a sand wedge;

said club irons each including a head having a geometric center and a weight concentrated at a fixed center of gravity substantially coincident with said geometric center, and a hosel extending therefrom, with each said hosel having a centerline;

said club irons further each having a lie angle defined as the angle between the intersection of the projected said centerline of said hosel and a horizontal ground plane tangent to said head;

said club irons further each having an arm defined as the distance between said projected said centerline of said hosel and said center of gravity, with said arm and said concentrated weight at said center of gravity of each of said club irons defining a moment of inertia for each of said club irons;

said one iron having a relatively longer arm and greater moment of inertia than said sand wedge and a positive hosel shift away from said center of gravity of said club head, with said positive hosel shift defined as a positive hosel shift distance from said intersection of said projected centerline of said hosel and said ground plane of said sand wedge to said intersection of said projected centerline of said hosel and said ground plane of said one iron;

said sand wedge having a relatively shorter arm and smaller moment of inertia than said one iron and a negative hosel shift toward said center of gravity of said club head, with said negative hosel shift defined as a negative hosel shift distance from said intersection of said projected centerline of said hosel and said ground plane of said one iron to said intersection of said projected centerline of said hosel and said ground plane of said sand wedge, whereby;

said relatively greater moment of inertia of said one iron relative to said sand wedge provides greater stability and less controllability for said one iron relative to said sand wedge, and said relatively smaller moment of inertia of said sand wedge relative to said one iron provides relatively greater controllability and less stability for said sand wedge relative to said one iron.

2. The set of golf club irons of claim 1 wherein:

each said head of said set of golf club irons is of a different weight, with said different weight of each said head increasing from said one iron through said sand wedge of said set of golf club irons.

3. The set of golf club irons of claim 2 wherein:

said increasing weight of each said head of said set of golf club irons is progressive, with said different weight of each said head having identical incremental weight differences.

4. The set of golf club irons of claim 1 wherein:

each said center of gravity has the same relative location within each said head of each of said club irons.

5. The set of golf club irons of claim 1 wherein:

said hosel shift distance of each of said club irons of said set of golf club irons is progressive, with said hosel shift distance of each of said club irons having incrementally identical differences.

6. The set of golf club irons of claim 1 wherein:

said moment of inertia of each of said club irons of said set of golf club irons is progressive, with said moment of inertia of each of said club irons having incrementally identical differences.

* * * * *